US010312579B2

(12) United States Patent
Hashimoto et al.

(10) Patent No.: US 10,312,579 B2
(45) Date of Patent: Jun. 4, 2019

(54) ARRAY ANTENNA DEVICE

(71) Applicant: KABUSHIKI KAISHA TOSHIBA, Minato-ku (JP)

(72) Inventors: Koh Hashimoto, Yokohama (JP); Masaki Nakamoto, Suginami (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 38 days.

(21) Appl. No.: 15/393,528

(22) Filed: Dec. 29, 2016

(65) Prior Publication Data

US 2017/0244161 A1 Aug. 24, 2017

(30) Foreign Application Priority Data

Feb. 23, 2016 (JP) ..... 2016-032196

(51) Int. Cl.
*H01Q 1/38* (2006.01)
*H01Q 21/00* (2006.01)
*H01Q 1/42* (2006.01)

(52) U.S. Cl.
CPC ..... *H01Q 1/38* (2013.01); *H01Q 1/42* (2013.01); *H01Q 21/00* (2013.01)

(58) Field of Classification Search
CPC ..... H01Q 1/38; H01Q 1/42; H01Q 21/00
See application file for complete search history.

(56) References Cited

U.S. PATENT DOCUMENTS 7,843,341 B2 * 11/2010 Phaneuf ..... B31D 1/025 235/375
8,446,330 B1 * 5/2013 McCarville ..... H01Q 21/26 29/592.1
9,865,924 B2 * 1/2018 Miura ..... H01Q 7/08
2005/0230966 A1 * 10/2005 Trantoul ..... G06K 19/025 283/117
2010/0067200 A1 * 3/2010 Ewe ..... G06K 19/07749 361/748

FOREIGN PATENT DOCUMENTS

JP 62-48107 3/1987
JP 10-322126 12/1998
JP 2003-78338 3/2003
JP 2004145668 A * 5/2004 ..... G06K 19/077

* cited by examiner

*Primary Examiner* — Tho G Phan
(74) *Attorney, Agent, or Firm* — Oblon, McClelland, Maier & Neustadt, L.L.P.

(57) ABSTRACT

An array antenna device according to an embodiment of the present invention includes an array antenna, a core layer, and a first adhesive layer. The array antenna has a first surface on which one or more radiating elements are disposed. The core layer is disposed facing the first surface. The first adhesive layer is present between the array antenna and the core layer and bonds the array antenna and the core layer to each other. The first adhesive layer includes one or more first openings and one or more radiating elements are disposed inside the first opening.

14 Claims, 9 Drawing Sheets

ARRAY ANTENNA DEVICE

CROSS-REFERENCE TO RELATED APPLICATION (S)

This application is based upon and claims the benefit of priority from Japanese Patent Application No. 2016-032196, filed Feb. 23, 2016; the entire contents of which are incorporated herein by reference.

FIELD

Embodiments described herein relate generally to an array antenna device.

BACKGROUND

A protection method is known in which a resin foam, serving as an antenna protecting layer, is bonded to the surface of an array antenna composed of a dielectric material on the radiating element side. This protection method leads to a smaller thickness of the antenna device than in the case where the antenna is protected by use of a radome which is out of mechanical contact with the radiating elements of the antenna. In addition, this protection method reduces an impact on the electric characteristics of the antenna body, thereby restraining a reduction in antenna gain, compared to the case where a plastic film layer, serving as a radome for protecting the antenna, is directly bonded to the surface of the array antenna on the radiating element side. Further, this protection method improves the planarity and mechanical strength of the antenna body.

However, bonding a resin foam to an antenna surface cause a problem of degrading the reflection characteristics of the radiating elements and the entire antenna since the non-uniformity of the adhesive or the adhesive layer causes variations in the impedance of each radiating element of the array antenna. Since the radiating elements have different reflection characteristics, the electromagnetic field distribution deviates from the designed values on the antenna aperture, so that the radiation pattern is degraded and the antenna gain is reduced.

There are still other problems such as the degradation in the cross polarization discrimination of the antenna.

DETAILED DESCRIPTION

An array antenna device according to an embodiment of the present invention includes an array antenna, a core layer, and a first adhesive layer.

The array antenna has a first surface on which one or more radiating elements are disposed.

The core layer is disposed facing the first surface.

The first adhesive layer is present between the array antenna and the core layer and bonds the array antenna and the core layer to each other.

The first adhesive layer includes one or more first openings and one or more radiating elements are disposed inside the first opening.

An embodiment of the present invention provides an array antenna device that has good antenna characteristics while the antenna is protected and the mechanical strength of the antenna is improved.

Below, a description is given of embodiments of the present invention with reference to the drawings. The present invention is not limited to the embodiments.

(First Embodiment)

Figure 1:
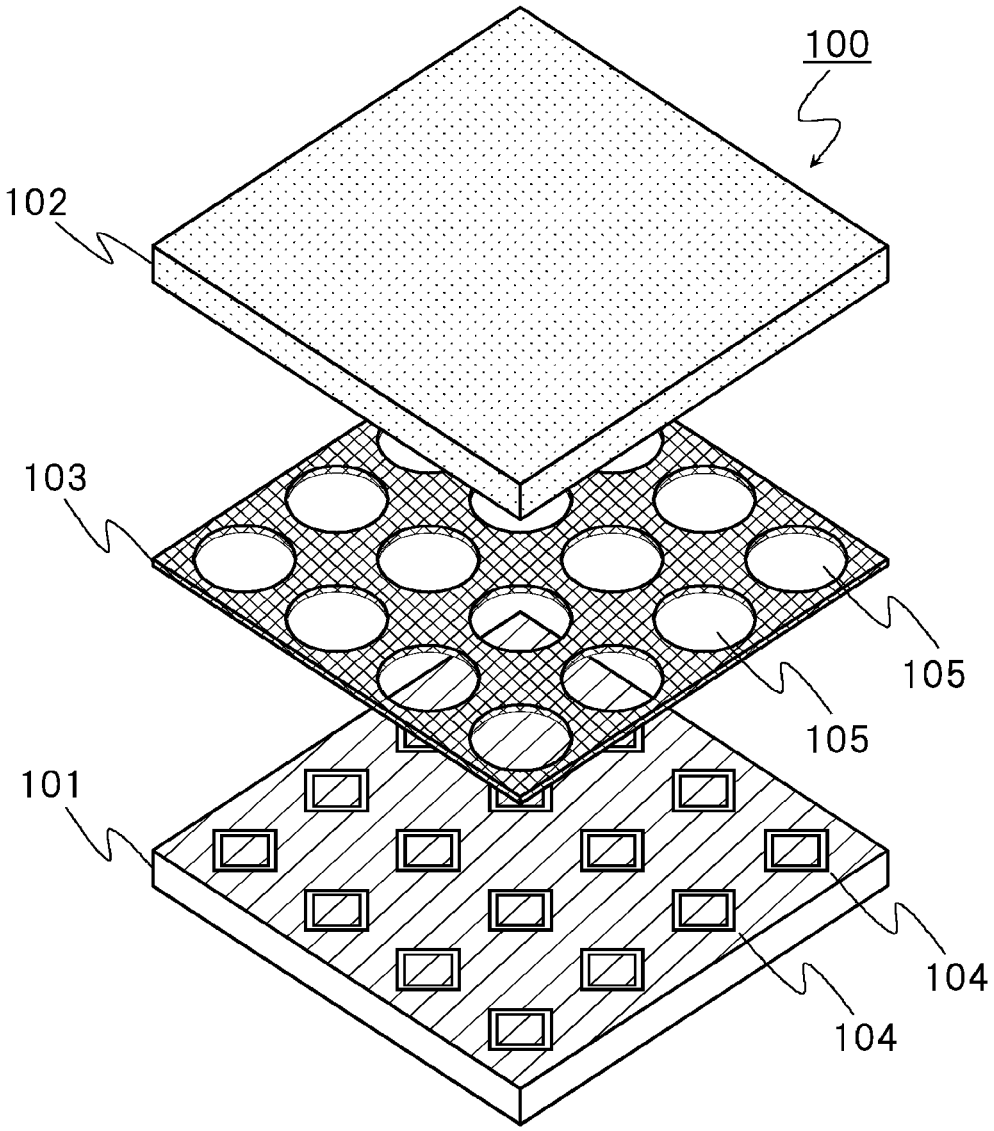
FIG. 1 is an exploded perspective view illustrating an example schematic configuration of an array antenna device according to the first embodiment.

FIG. 1 is an exploded perspective view illustrating an example schematic configuration of an array antenna device according to the first embodiment. An array antenna device 100 according to the first embodiment includes an array antenna 101, a low dielectric constant core (core layer) 102, and a first adhesive layer 103.

The array antenna 101 has one or more radiating elements 104 on a surface. These radiating elements 104 emit electromagnetic waves. The array antenna 101 can be formed, for example, on a dielectric substrate. As the dielectric substrate, substrate of a resin such as polytetrafluoroethylene (PTFE) and epoxy or substrate of a film such as a resin foam and a liquid crystal polymer can be used.

Examples of the radiating elements 104 include patch antennas, slot antennas, and slot loop antennas.

The low dielectric constant core 102 is disposed to face a surface of the array antenna 101 having the radiating elements 104. For example, a resin foam is used as the low dielectric constant core 102.

The first adhesive layer 103 is present between the array antenna 101 and the low dielectric constant core 102, bonding the array antenna 101 and the low dielectric constant core 102 to each other. For example, the first adhesive layer 103 may be a sheet-shaped thermoplastic resin or thermosetting resin. Using sheet-shaped resin layer as an adhesive layer enable to simplify the process of bonding. Alternatively, the first adhesive layer 103 may be formed of a fluid adhesive. A fluid adhesive may be applied to the array antenna 101 or the low dielectric constant core 102, and the applied adhesive may be used as the first adhesive layer 103.

The first adhesive layer 103 includes one or more first openings 105. One or more first openings 105 are provided in an adhesive surface for bonding the array antenna 101 and the first adhesive layer 103 to each other, in positions where they face the radiating elements 104 on a surface of the array antenna 101. In other words, one or more the radiating elements 104 are disposed inside the first openings 105 in bonding the array antenna 101 and the first adhesive layer 103. Thereby, the radiating element 104 and the first adhesive layer 103 are not bonded to each other.

Figure 2:
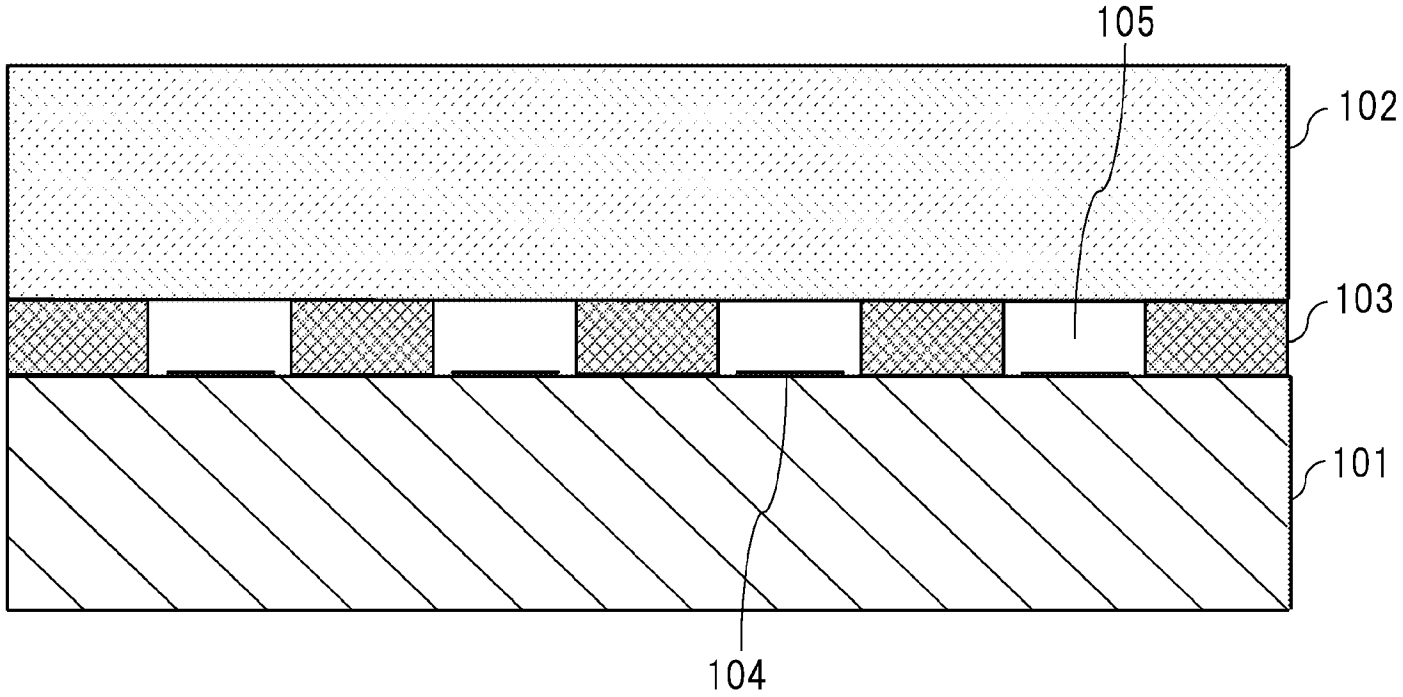
FIG. 2 is a cross sectional view illustrating an example schematic configuration of the array antenna device according to the first embodiment.

FIG. 2 is an example cross sectional view of the array antenna device 100 according to the first embodiment. The drawing shows the radiating elements 104 disposed on a surface of the array antenna 101 are inside the first openings 105 and are not bonded to the first adhesive layer 103.

When a sheet-shaped resin layer are used as the first adhesive layer 103, the first opening 105 should be provided in advance. When a fluid adhesive forms the first adhesive layer 103, the fluid adhesive may be applied avoiding the radiating elements 104.

When the first adhesive layer 103 bonds the array antenna 101 and the low dielectric constant core 102 which is a resin foam, the first adhesive layer 103 penetrates into the foams in the low dielectric constant core 102 (resin foam). Since the foams are not uniform in the low dielectric constant core 102 (resin foam), the first adhesive layer 103 becomes non-uniform. When the non-uniform first adhesive layer 103 covers the radiating elements 104, the impedance of each radiating element changes, which degrades the reflection characteristics of the radiating elements and the entire antenna. Since the reflection characteristics vary between the radiating elements, the electromagnetic field distribution deviates from the designed values on the antenna apertures, so that the radiation pattern is degraded and the antenna gain is reduced. Besides, there arises a problem that the cross-polar discrimination of the antenna degrades. To avoid these, the first adhesive layer 103 according to this embodiment has the first openings 105 and passes many electromagnetic waves from the radiating elements 104 through the first openings 105 in order to prevent degradation in the various characteristics of the antenna. Electromagnetic waves which may possibly pass through not the first opening 105 but the first adhesive layer 103 are so little that they have a very little impact on the various characteristics of the antenna. Consequently, this embodiment can achieve good antenna characteristics.

Here, it is assumed that none of the radiating elements 104 are bonded to the first adhesive layer 103. Alternatively, one or more particular radiating elements 104 may not be bonded to the first adhesive layer 103.

In FIGS. 1 and 2, when the array antenna 101 and the low dielectric constant core 102 are bonded to each other, one first opening 105 contains one radiating element 104. In other words, each first opening 105 and the corresponding radiating element 104 are paired with each other. However, the number, positions, and width of first openings 105 are not necessarily like these. One first opening 105 may contain a plurality of radiating elements 104. For example, more than one first openings 105 shown in the drawing may be collected into one big opening.

Although the openings of first openings 105 are circular in FIG. 1, they may be in a rectangular, polygonal, or any other complex shape as long as the regions other than the first openings 105 are not in contact with the radiating elements 104.

As described above, in the first embodiment, the array antenna 101 and the low dielectric constant core 102 are bonded to each other with the first adhesive layer 103 having a plurality of first openings 105 in regions facing a plurality of radiating elements 104 disposed on the surface of the array antenna 101. Thereby, it is possible to restrain degradation in the various characteristics of the antenna due to non-uniformity of an adhesive or adhesive sheet for bonding the antenna surface and the antenna protective layer while achieving the protection of the array antenna and an improvement in mechanical strength. Moreover, the thickness of the array antenna device can be reduced.

(Second Embodiment)

Figure 3:
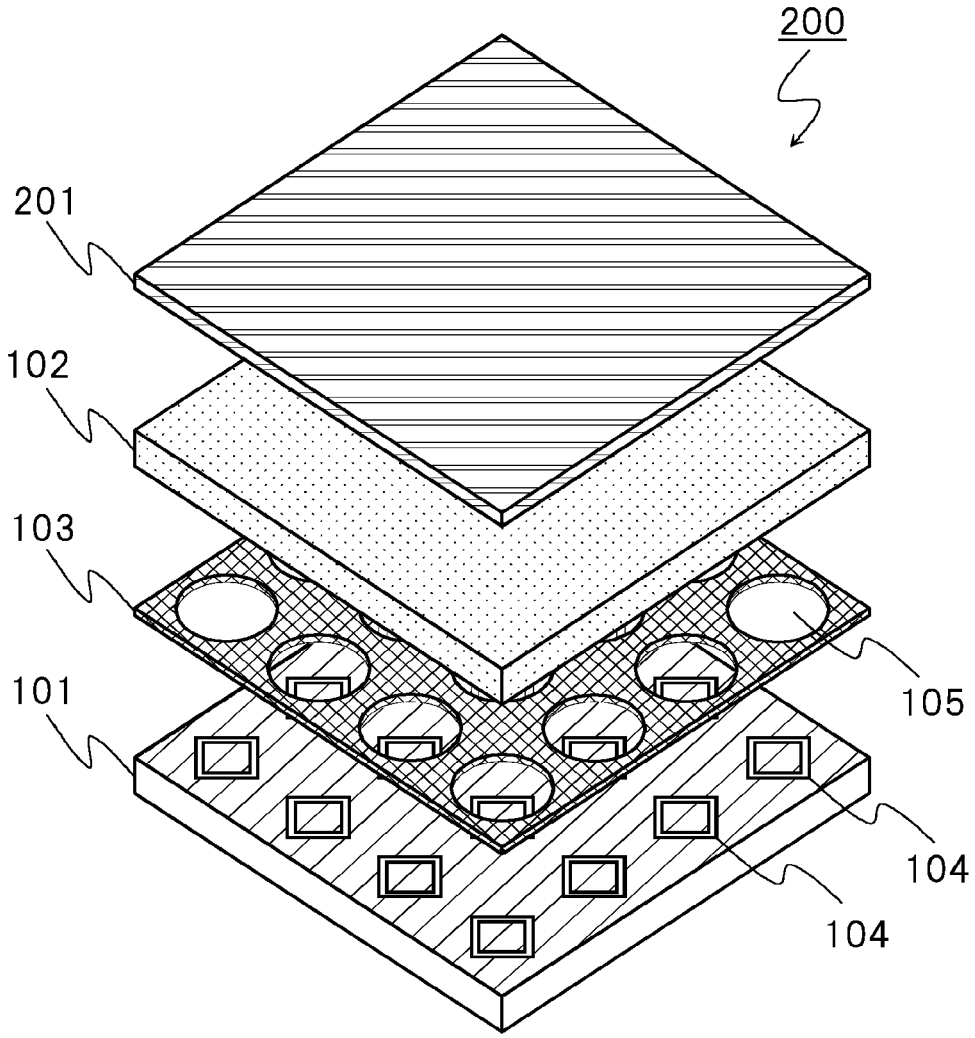
FIG. 3 is an exploded perspective view illustrating an example schematic configuration of an array antenna device according to the second embodiment.

FIG. 3 is an exploded perspective view illustrating an example schematic configuration of an array antenna device 200 according to the second embodiment. The second embodiment differs from the first embodiment in that the second embodiment further includes a skin (skin layer) 201 which has a higher dielectric constant than the low dielectric constant core 102. The description of the points similar to those in the first embodiment will be omitted.

The skin 201 is disposed in contact with the surface of the low dielectric constant core 102 opposite to the surface bonded to the array antenna 101. The skin 201 may be a polytetrafluoroethylene (PTFE) that is highly resistant to climate and radiowave attenuation, a fiber-reinforced plastic (FRP) that has high mechanical strength, or the like.

With the skin 201 disposed as in FIG. 3, the protective performance for the array antenna device 200 is higher than in the first embodiment which uses only the low dielectric constant core 102 that has low strength. Since the protective performance for the array antenna device 100 is improved, an insulating honeycomb structure without a function for protecting an antenna can be used as the low dielectric constant core 102. Since an insulating honeycomb structure has a lower specific gravity than a resin foam, the weight of the array antenna device 200 can be reduced.

When a honeycomb structure is used, the first adhesive layer 103 is non-uniform as in a resin foam and the various characteristics of the antenna are degraded. However, in this embodiment, the non-uniform first adhesive layer 103 does not cover the radiating elements 104 because of a plurality of first openings 105 disposed facing a plurality of radiating elements 104 disposed on a surface of the array antenna 101. Thereby, it is possible to prevent degradation in various characteristics of the antenna.

As described above, in the second embodiment, the array antenna device 200 includes the skin 201, providing higher protective performance for the antenna than in the first embodiment. In addition, when the low dielectric constant core 102 is an insulating honeycomb structure, the array antenna device 200 is more lightweight than in the first embodiment.

(Third Embodiment)

Figure 4:
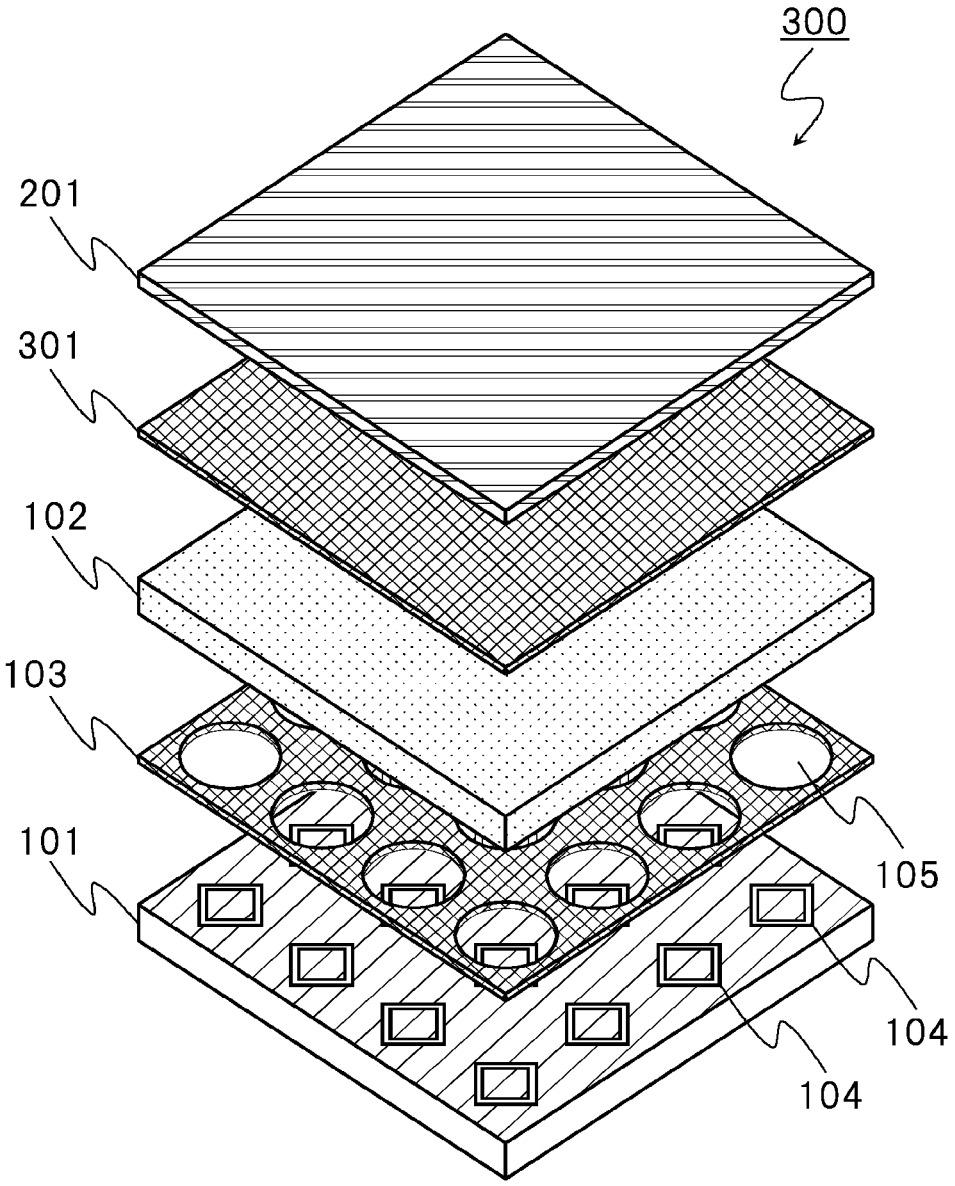
FIG. 4 is an exploded perspective view illustrating an example schematic configuration of an array antenna device according to the third embodiment.

FIG. 4 is an exploded perspective view illustrating an example schematic configuration of an array antenna device 300 according to the third embodiment. The third embodiment differs from the second embodiment in that the third embodiment further includes a second adhesive layer 301 between the low dielectric constant core 102 and the skin 201. The description of the points similar to those in the second embodiment will be omitted.

The second adhesive layer 301 bonds the low dielectric constant core 102 and the skin 201 to each other. The second adhesive layer 301 may be, like the first adhesive layer 103, a thermosetting resin sheet or a fluid adhesive. With the low dielectric constant core 102 and the skin 201 bonded to each other, the mechanical strength of the antenna is higher than that in the second embodiment.

As described above, in the third embodiment, the array antenna device 300 further includes the second adhesive layer 301 for bonding the low dielectric constant core 102 and the skin 201 to each other, providing higher mechanical strength of the array antenna device than in the second embodiment.

(Fourth Embodiment)

Figure 5:
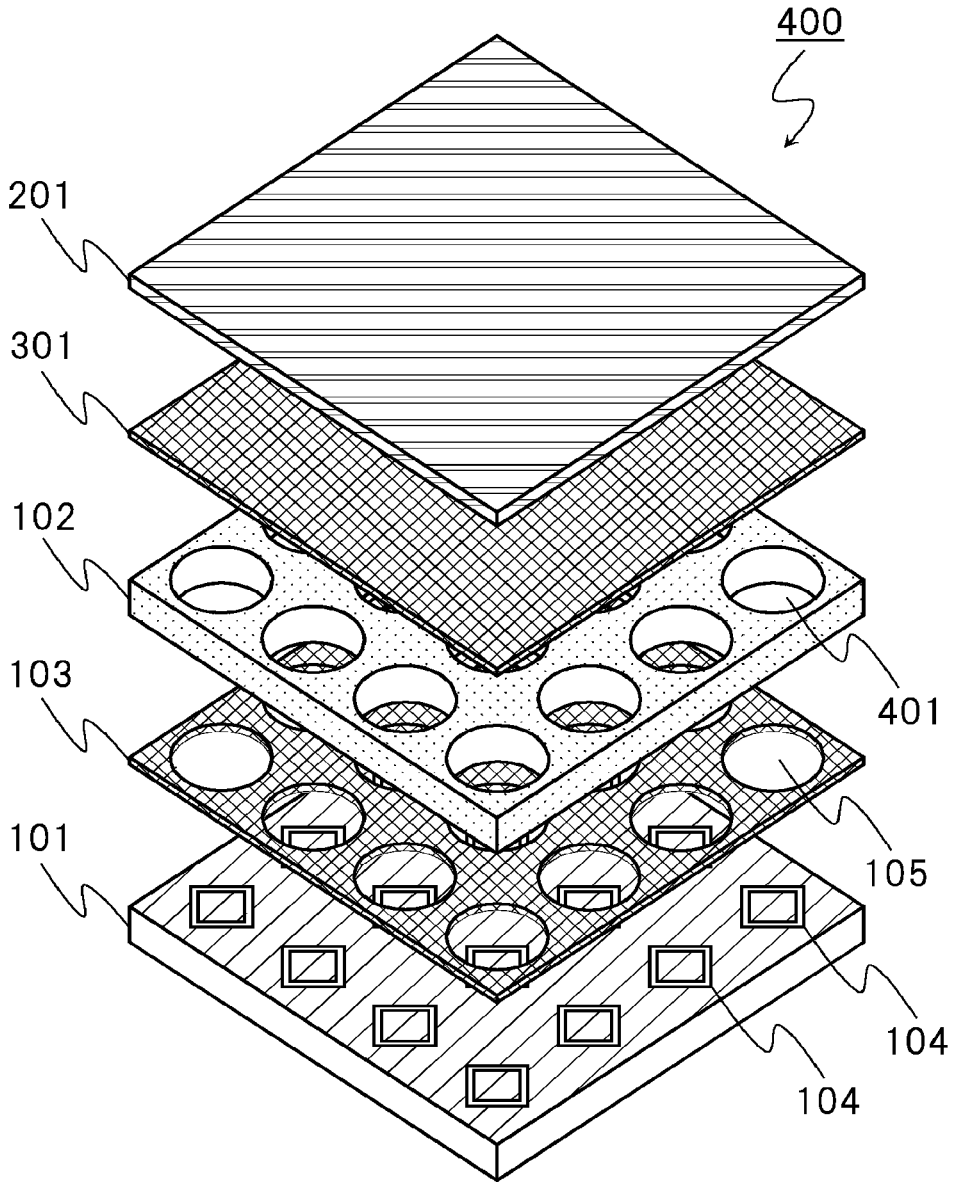
FIG. 5 is an exploded perspective view illustrating an example schematic configuration of an array antenna device according to the fourth embodiment.

FIG. 5 is an exploded perspective view illustrating an example schematic configuration of an array antenna device 400 according to the fourth embodiment. The fourth embodiment differs from the third embodiment in that the low dielectric constant core 102 includes second openings 401. The description of the points similar to those in the third embodiment will be omitted. It should be noted that the low dielectric constant core 102 according to the second embodiment may have the second openings 401. an embodiment where the low dielectric constant core 102 according to the second embodiment has the second openings 401 differs from the fourth embodiment only in that it does not have the second adhesive layer 301. Accordingly, its description will be also omitted.

When the array antenna device 400 is used as a transmitting antenna, electromagnetic waves emitted by each radiating element 104 partly pass through the second openings 401 provided in the low dielectric constant core 102. In other words, electromagnetic waves emitted by each radiating element 104 are partly propagated without being blocked by the low dielectric constant core 102, thereby reducing a dielectric loss generated by the low dielectric constant core 102. Thus, the antenna performance is higher than those in the previous embodiments.

Figure 6:
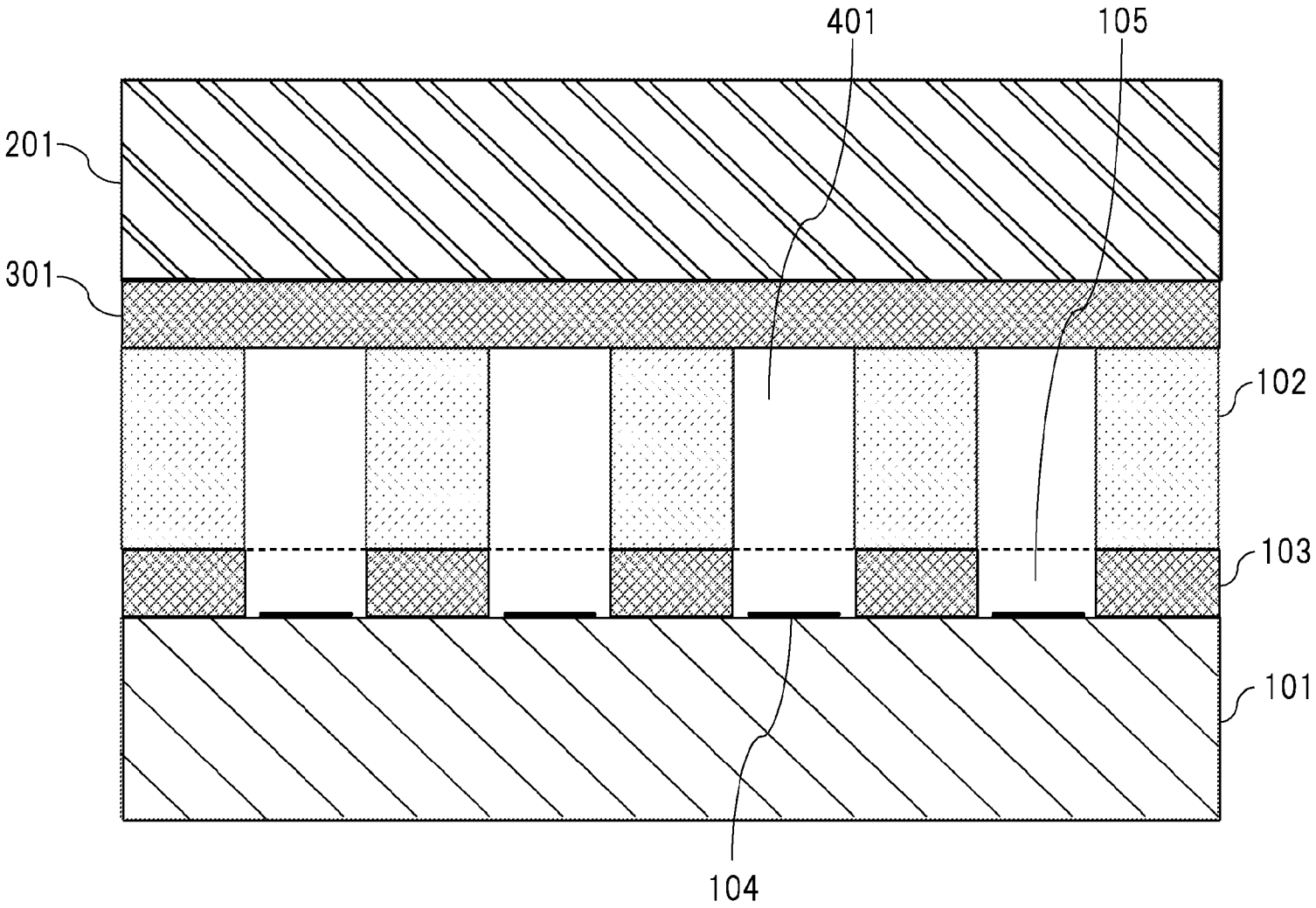
FIG. 6 is a cross sectional view illustrating an example schematic configuration of the array antenna device according to the fourth embodiment.

FIG. 6 is a cross sectional view illustrating an example schematic configuration of the array antenna device 400 according to the fourth embodiment. The drawing shows that electromagnetic waves emitted by the radiating elements 104 and passing through the first openings 105 provided in the array antenna 101 directly pass through the second openings 401 provided in the low dielectric constant core 102.

In FIGS. 5 and 6, each second opening 401 formed in the low dielectric constant core 102 and the corresponding radiating element 104 formed in the array antenna 101 are paired with each other. However, the number, positions, and width of second openings 401 are not necessarily like these. When the array antenna 101 and the low dielectric constant core 102 are bonded to each other, a plurality of radiating elements 104 may be disposed in a portion in the array antenna 101 which is directly below one second opening 401. For example, more than one second openings 401 shown in the drawing may be collected into one big opening.

Although the openings of second openings 401 are circular in FIG. 5, they may be in a rectangular, polygonal, or any other complex shape.

When the array antenna device 400 is used as a receiving antenna, a dielectric loss generated by the low dielectric constant core 102 is reduced according to the reciprocity theorem. For this reason, in the case that the array antenna device 400 is used as a receiving antenna, the antenna performance is higher than those in the previous embodiments.

As described above in the fourth embodiment, a dielectric loss generated by the low dielectric constant core 102 can be reduced with the low dielectric constant core 102 having the second openings 401 in regions facing the plurality of radiating elements 104 on the array antenna 101. Thus, the antenna characteristics are higher than those in the second and third embodiments.

(Fifth Embodiment)

Figure 7:
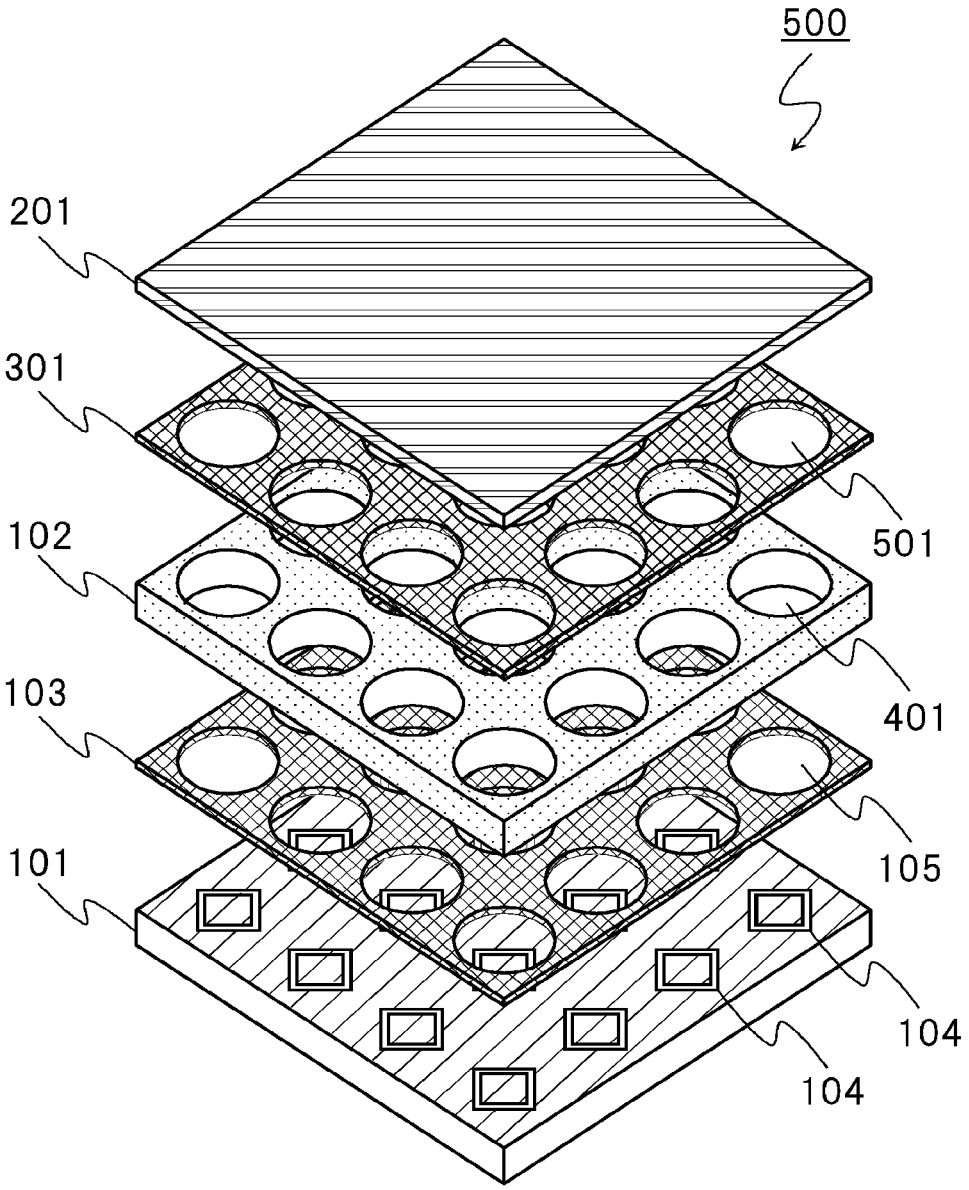
FIG. 7 is an exploded perspective view illustrating an example schematic configuration of an array antenna device according to the fifth embodiment.

FIG. 7 is an exploded perspective view illustrating an example schematic configuration of an array antenna device 500 according to the fifth embodiment. The fifth embodiment differs from the fourth embodiment in that the second adhesive layer 301 includes third openings 501. The description of the points similar to those in the fourth embodiment will be omitted. It should be noted that the second adhesive layer 301 according to the third embodiment may have the third openings 501. an embodiment where the second adhesive layer 301 according to the third embodiment has the third openings 501 differs from the fifth embodiment only in that the low dielectric constant core 102 does not have the second openings 401. Accordingly, its description will be also omitted.

When the array antenna device 500 is used as a transmitting antenna, electromagnetic waves emitted by each radiating element 104 partly pass through the third openings 501 provided in the second adhesive layer 301. In other words, electromagnetic waves emitted by each radiating element 104 are partly propagated without being blocked by the second adhesive layer 301, thereby reducing a dielectric loss generated by the second adhesive layer 301. Thus, the antenna performance is higher than those in the previous embodiments.

Figure 8:
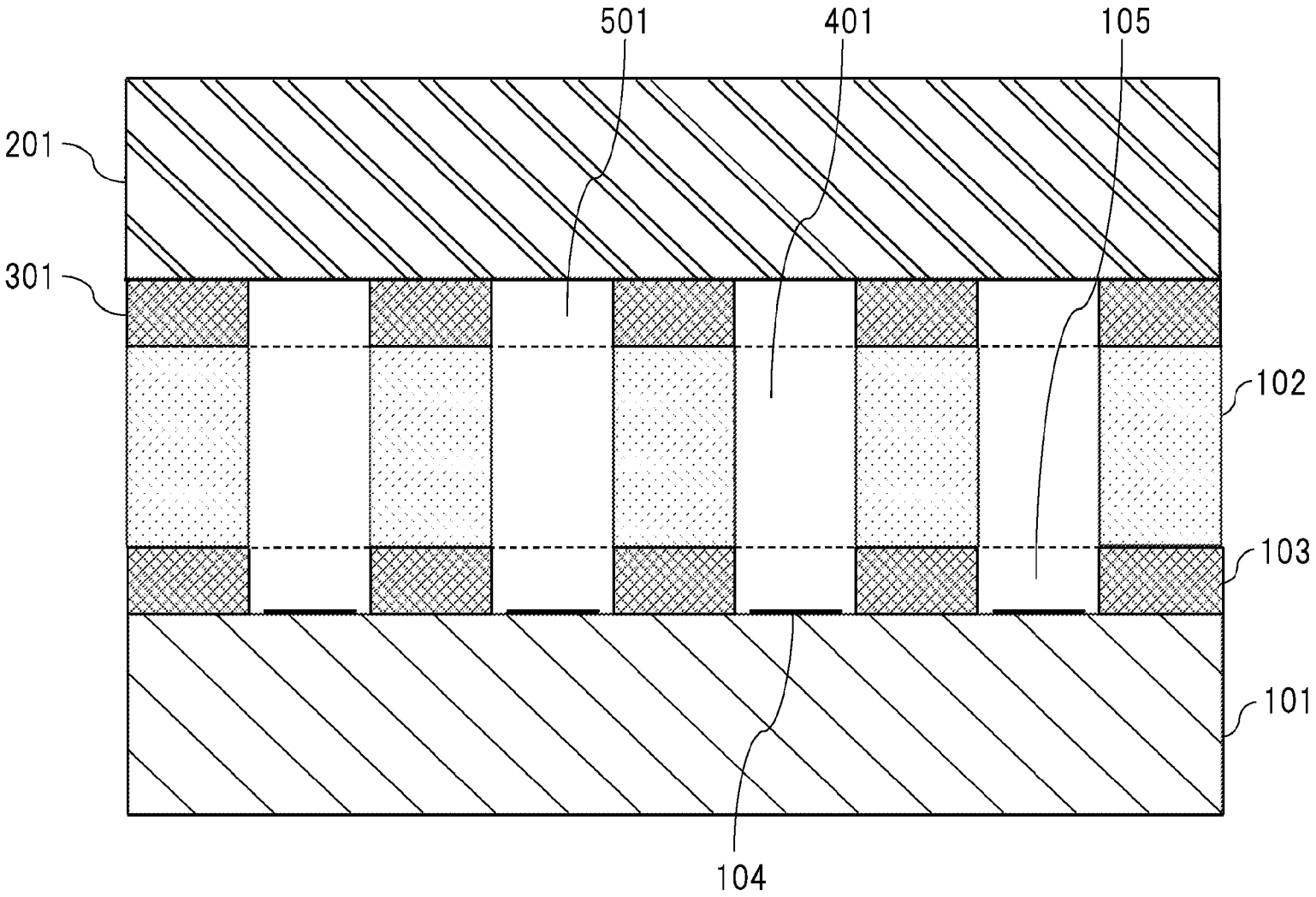
FIG. 8 is a cross sectional view illustrating an example schematic configuration of the array antenna device according to the fifth embodiment.

FIG. 8 is a cross sectional view illustrating an example schematic configuration of the array antenna device 500 according to the fifth embodiment. The drawing shows that electromagnetic waves emitted by the radiating elements 104 and passing through the first openings 105 provided in the array antenna 101 and the second openings 401 provided in the low dielectric constant core 102 directly pass through the third openings 501 provided in the second adhesive layer 301.

Although each third opening 501 formed in the second adhesive layer 301 and the corresponding radiating element 104 formed in the array antenna 101 are paired, this is not necessarily the case. As for the third openings 501, when the array antenna 101 and the low dielectric constant core 102 are bonded to each other, a plurality of radiating elements 104 may be disposed in a portion in the array antenna 101 which is directly below one third opening 501.

In FIGS. 7 and 8, each third opening 501 formed in the second adhesive layer 301 and the corresponding radiating element 104 formed in the array antenna 101 are paired with each other. However, the number, positions, and width of third openings 501 are not necessarily like these. When the second adhesive layer 301 and the low dielectric constant core 102 are bonded to each other, a plurality of radiating elements 104 may be disposed in a portion in the array antenna 101 which is directly below one third opening 501. For example, more than one third openings 501 shown in the drawing may be collected into one big opening.

Although the plurality of third openings 501 in FIG. 7 are circular, they may be in a rectangular, polygonal, or any other complex shape.

When the array antenna device 500 is used as a receiving antenna, a dielectric loss generated by the second adhesive layer 301 is reduced according to the reciprocity theorem. For this reason, in the case that the array antenna device 500 is used as a receiving antenna, the antenna performance is higher than those in the previous embodiments.

As described above in the fifth embodiment, a dielectric loss generated by the second adhesive layer 301 can be reduced with the second adhesive layer 301 having the third openings 501 in regions facing the plurality of radiating elements 104 on the array antenna 101. Thus, the antenna characteristics are higher than those in the third and fourth embodiments.

(Sixth Embodiment)

Figure 9:
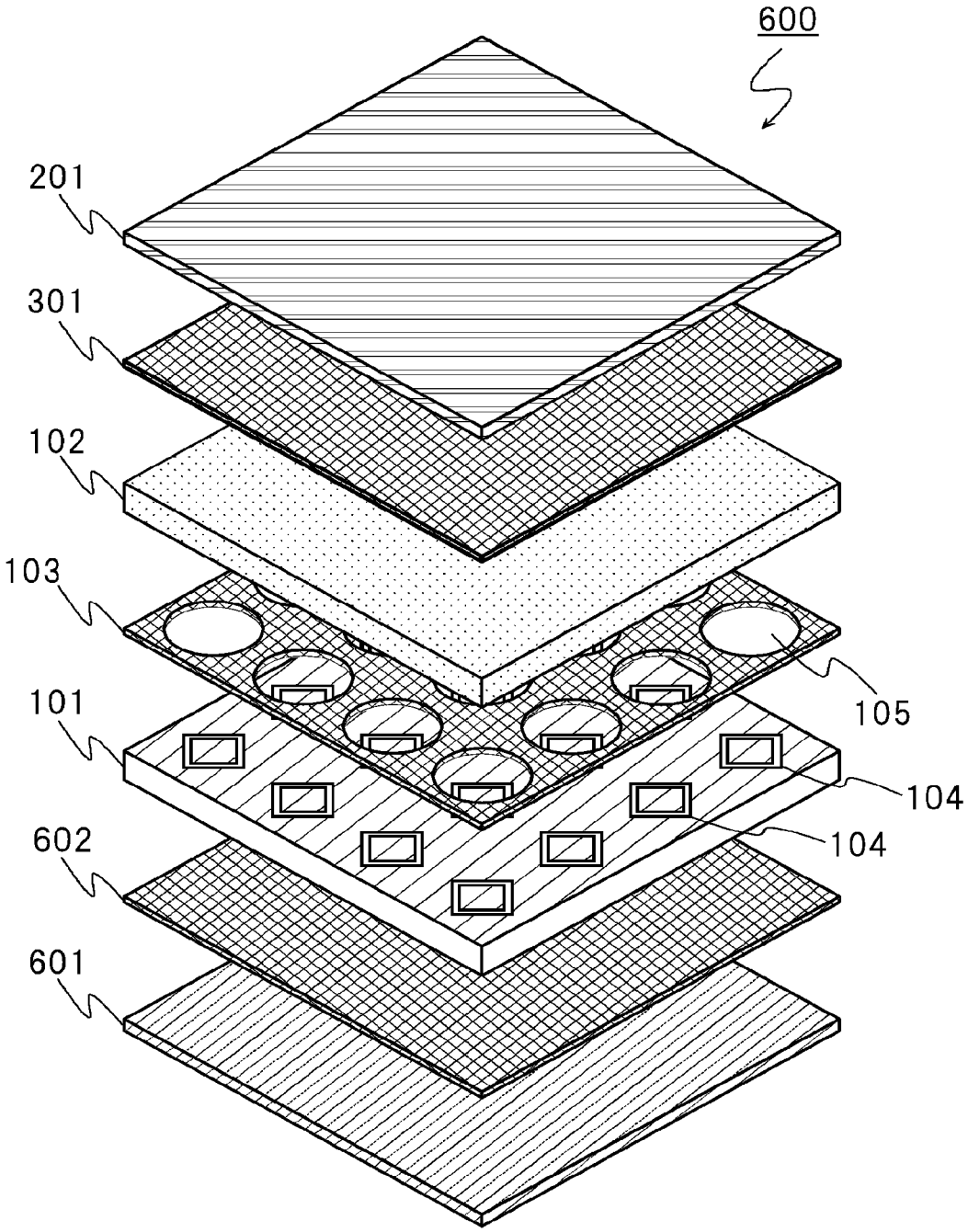
FIG. 9 is an exploded perspective view illustrating an example schematic configuration of an array antenna device according to the sixth embodiment.

FIG. 9 is an exploded perspective view illustrating an example schematic configuration of an array antenna device 600 according to the sixth embodiment. The sixth embodiment differs from the third embodiment in that the sixth embodiment further includes a reinforcement 601 and a third adhesive layer 602. The description of the points similar to those in the third embodiment will be omitted. The other embodiments may also further include the reinforcement 601 and the third adhesive layer 602.

The reinforcement 601 is fixed to the surface of the array antenna 101 opposite to the surface on which the radiating elements 104 are disposed. The reinforcement 601 may be composed of, a metal, a resin foam, a honeycomb structure, an FRP, or a combination of part or all of them. With the reinforcement 601, the mechanical strength of the array antenna device 600 becomes higher than those in the previous embodiments.

The third adhesive layer 602 fixes the array antenna 101 and the reinforcement 601 to each other. The third adhesive layer 602 may be the same as the first adhesive layer 103 or the second adhesive layer 301. Alternatively, the third adhesive layer 602 may be either an adhesive sheet or an adhesive coating. It should be noted that when the third adhesive layer 602, the first adhesive layer 103, and the second adhesive layer 301 are composed of the same material, the array antenna 101, the low dielectric constant core 102, the skin 201, and the reinforcement 601 can be bonded to each other in one step, thereby simplifying a process for manufacturing the array antenna device 600. It should be noted that the reinforcement 601 and the array antenna 101 may be fixed to each other by screws without the use of the third adhesive layer 602.

As described above, in the sixth embodiment, the reinforcement 601 fixed to the surface of the array antenna 101 opposite to the surface on which the radiating elements 104 are disposed makes the mechanical strength of the array antenna device 600 higher than the previous embodiments.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An array antenna device comprising:

an array antenna that has a first surface on which one or more radiating elements are disposed;

a core layer that is disposed facing the first surface; and a first adhesive layer that is present between the array antenna and the core layer and bonds the array antenna and the core layer to each other, wherein the first adhesive layer includes one or more first openings, and at least one of the radiating elements is disposed entirely inside any one of the first openings.

2. The array antenna device according to claim 1, further comprising a skin layer that has a higher dielectric constant than the core layer and is disposed facing the surface of the core layer opposite to the first surface.

3. The array antenna device according to claim 2, wherein the core layer is a resin foam or an insulating honeycomb structure.

4. The array antenna device according to claim 2, further comprising a second adhesive layer bonding the skin layer and the core layer to each other.

5. The array antenna device according to claim 4, wherein at least one of the first adhesive layer and the second adhesive layer is a sheet-shaped resin layer.

6. The array antenna device according to claim 4, wherein the second adhesive layer includes a third opening, and one or more radiating elements are disposed in a portion in the array antenna which is directly below the third opening.

7. The array antenna device according to claim 2, wherein the core layer includes a second opening, and one or more radiating elements are disposed in a portion in the array antenna which is directly below the second opening.

8. The array antenna device according to claim 1, further comprising a reinforcement fixed to a second surface opposite to the first surface.

9. The array antenna device according to claim 8, wherein the reinforcement is bonded to the second surface.

10. The array antenna device according to claim 1, wherein the array antenna is formed on a dielectric substrate.

11. The array antenna device according to claim 1, wherein the first adhesive layer penetrates into the core layer.

12. The array antenna device according to claim 1, wherein the first adhesive layer has a protrusion into a surface of the core layer which is facing the first surface.

13. The array antenna device according to claim 1, wherein the first adhesive layer is non-uniform.

14. The array antenna device according to claim 1, wherein the one or more radiating elements and the first adhesive layer are not bonded to each other.

* * * * *